United States Patent [19]

Hammer

[11] 4,422,010

[45] Dec. 20, 1983

[54] SHAPED DISCHARGE LAMP WITH STARTING AID

[75] Inventor: Edward E. Hammer, Mayfield Village, Ohio

[73] Assignee: General Electric Company, Schenectady, N.Y.

[21] Appl. No.: 371,143

[22] Filed: Apr. 23, 1982

Related U.S. Application Data

[63] Continuation-in-part of Ser. No. 253,089, Apr. 13, 1981, abandoned.

[51] Int. Cl.[3] ..... H01J 61/30; H01J 61/54

[52] U.S. Cl. ..... 313/594; 313/634; 362/216

[58] Field of Search ..... 313/201, 493, 492, 607, 313/594, 634; 362/216

[56] References Cited

U.S. PATENT DOCUMENTS

| | | | |
|---|---|---|---|
| 2,624,023 | 12/1952 | Noel et al. | 313/201 |
| 2,683,836 | 7/1954 | Lemmers . | |
| 2,731,577 | 1/1956 | Floyd | 313/201 X |
| 2,733,371 | 1/1956 | Campbell . | |
| 2,795,724 | 6/1957 | Beeson | 313/201 X |
| 2,829,295 | 4/1958 | Gast et al. . | |
| 3,548,241 | 12/1970 | Rasch et al. | 313/493 |
| 3,780,329 | 12/1973 | Otsuka et al. | 313/226 X |
| 4,321,502 | 3/1982 | Hammer et al. | 313/201 X |

*Primary Examiner*—Palmer C. Demeo

*Attorney, Agent, or Firm*—Philip L. Schlamp; Fred Jacob

[57] ABSTRACT

A discharge lamp comprising an elongated bulb shaped so that its ends are substantially closer together than if the bulb were straight and containing electrodes respectively near the ends thereof, and a starting aid comprising conductive means respectively adjacent to said bulb in the vicinity of said electrodes, and means electrically interconnecting said conductive means.

8 Claims, 7 Drawing Figures

SHAPED DISCHARGE LAMP WITH STARTING AID

This is a continuation-in-part of patent application Ser. No. 253,089, filed Apr. 13, 1981, abandoned.

CROSS-REFERENCE TO RELATED APPLICATION

Ser. No. 99,618, filed Dec. 3, 1979, Hammer and Lemmers, "U-Shaped Discharge Lamp With Starting Strip", now U.S. Pat. No. 4,321,502 and assigned the same as this invention.

BACKGROUND OF THE INVENTION

The invention is in the field of discharge lamps, such as fluorescent lamps, having an elongated bulb shaped so that its ends are substantially closer together than if the bulb were straight, and containing electrodes near the ends of the bulb. Examples of such lamps are U-shaped lamps, circular lamps, double spiral lamps, and half-circle lamps.

U.S Pat. No. 3,548,241 to Rasch discloses a U-shaped fluorescent lamp construction of the type having a support strap clamped around the ends of the lamp to improve its rigidity. The lamp does not employ a starting strip. Starting strips are conventionally provided on straight fluorescent lamps, for reducing their starting voltage. U.S. Pat. No. 2,683,836 to Lemmers discloses a narrow starting strip of conductive material carried on a straight lamp bulb. The starting strip can also be in the form of a coating, usually inside the bulb, of a transparent conductor such as tin oxide, or stannous chloride as disclosed in U.S. Pat. No. 2,733,371 to Campbell. Conventional starting strips are difficult and time-consuming to apply to U-shaped lamps, and if applied prior to bending the bulb into a U-shape, the strip is likely to break or develop high resistance when the bulb is bent.

The above-referenced patent application is directed to U-shaped discharge lamps having conductive starting strips extending partly along the bulb.

SUMMARY OF THE INVENTION

An object of the invention is to provide an improvement in starting aids for U-shaped lamps and other discharge lamps having an elongated bulb shaped so that its ends are substantially closer together than if the bulb were straight.

The invention comprises, briefly and in a preferred embodiment, a discharge lamp comprising an elongated bulb shaped so that its ends are substantially closer together than if the bulb were straight and containing electrodes respectively near the ends thereof, and a starting aid comprising conductive means respectively adjacent to said bulb in the vicinity of said electrodes, and means spatially electrically interconnecting said conductive means. The aforesaid interconnecting means may be, or may be combined with, a bulb support strap attached to and extending between the ends of the bulb. Preferably, the aforesaid conductive means partially encircle the bulb legs at the vicinity of each electrode, in C-shaped configurations, the openings of these configurations substantially lying in a plane defined by a U-shaped side edge of the bulb. For optimum lamp starting, such a lamp is mounted in a fixture with the openings of the starting aid conductive means facing toward the metal surface of the fixture.

DESCRIPTION OF THE PREFERRED EMBODIMENTS

Figure 1:
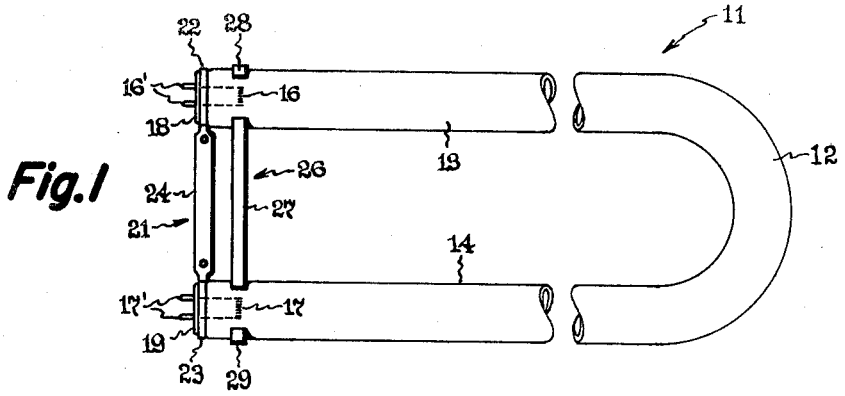
FIG. 1 is a top view of a U-shaped discharge lamp in accordance with a preferred embodiment of the invention.

The U-shaped discharge lamp of FIG. 1 comprises a U-shaped bulb 11 having a U-bend portion 12 and a pair of mutually parallel straight legs 13, 14. A pair of filaments 16 and 17 are respectively mounted in the bulb near the ends thereof, and respectively connected to pairs of connector terminals 16' and 17'. A pair of short cylindrical metal end caps 18 and 19 are cemented to the ends of the bulb, for supporting the connector terminals 16' and 17' by means of an insulative mounting disc, in conventional manner. In order to mutually brace the ends of the bulb 11, a support strap 21 is provided and comprises circular metal bands 22, 23 respectively tightly encircling the end caps 18 and 19, these bands 22 and 23 being attached to and interconnected by a spatially extending rigid metal lateral strap 24. The lamp described thus far is generally similar to that disclosed in the above-referenced Rasch patent. Conventionally, bulb 11 contains a quantity of mercury to provide a mercury vapor discharage path in the lamp. Also, a gas fill such as argon is provided in the bulb to aid in starting, or in more recent energy-saving lamps, the fill gas is a mixture of krypton and argon.

Figure 2:
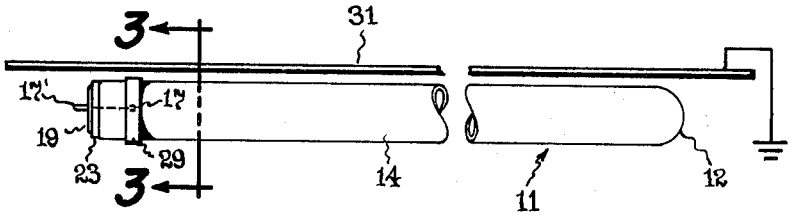
FIG 2 is a side view of the lamp of FIG. 1, positioned with respect to a reflective fixture.
Figure 3:
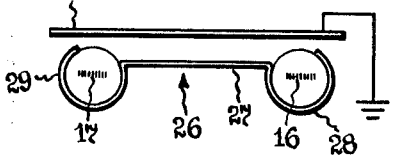
FIG. 3 is a cross-sectional view taken on the line 3—3 of FIG. 2.

In accordance with the invention, in the embodiment shown in FIGS. 1 through 3, a starting aid 26 is provided for the U-shaped lamp 11, and comprises a metal or other electrically conductive strip shaped to have a substantially straight section 27 extending spatially between the bulb legs 13 and 14, and shaped at the ends thereof to respectively provide bands 28 and 29 which at least partially surround the respective legs 13 and 14 in the vicinity of the cathode electrodes 16, 17. The starting aid 26 may be secured to the lamp by means of the bands 28, 29 snugly fitting the legs 13, 14 and/or by being adhesively secured to these lamp legs 13, 14. Preferably, the bands 28, 29 each partially surrounds the respective legs 13, 14, in C-shaped configurations, with the open portions of the C-shaped configurations substantially lying in a plane defined by a U-shaped side edge of the bulb, as is most clearly shown in FIGS. 1 and 3. When the lamp is mounted in a conventional lighting fixture having a sheet-like metal or other conductive member 31, which is electrically grounded and may be provided with a coating of white enamel or other suitable light-reflecting material, the lamp 11 being mounted adjacent and parallel to this conductive sheet 31, starting of the lamp 11 is found to be improved if it is mounted with the openings of the C-shaped starting aid bands 28, 29 facing toward the conductive sheet 31, as is most clearly shown in FIG. 3.

Figure 4:
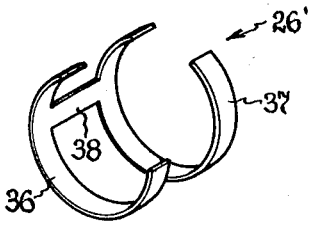
FIG. 4 is a perspective view of a starting aid clip in accordance with an alternative preferred embodiment of the invention, two such clips being employed in a lamp.
Figure 5:
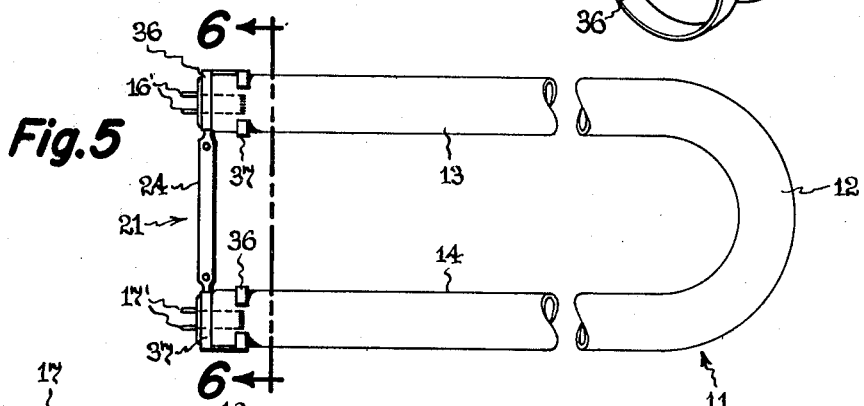
FIG. 5 is a top view of the alternative preferred embodiment of the invention, employing a pair of clips such as shown in FIG. 4.
Figure 6:
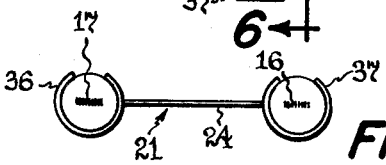
FIG. 6 is a cross-sectional view taken on the line 6—6 of FIG. 5.

In the alternative preferred embodiment of FIGS. 4 through 6, the starting aid comprises a pair of double conductive bands 36 and 37, each having a C-shaped configuration and being mutually spaced apart in a parallel oriented manner, and joined and held together by an integral conductive separator portion 38, as clearly shown in FIG. 4. A pair of these starting aids 26' is employed on a lamp, respectively surrounding each of the lamp legs 13 and 14 near the end thereof, with one of the bands 36, 37 encircling the bulb in the vicinity of a cathode electrode 16, 17 and the other band surrounding and in electrical contact with the metal bases 18, 19, whereby the support strap 24 electrically interconnects the two starting aid bands 26', whereby this embodiment of the starting aid is electrically equivalent to the starting aid 26 of FIGS. 1 through 3.

The starting aid of the invention helps the starting of lamps at least as effectively as the more conventional starting stripes along the bulb. The reason for this is not fully known because it would seem that the lateral starting aid configuration of the invention is contrary to the principles of starting stripes along the bulb. It is believed that the starting aid of the invention creates an electric field distortion in the region of the cathodes which aids in the initial electron breakdown process.

Figure 7:
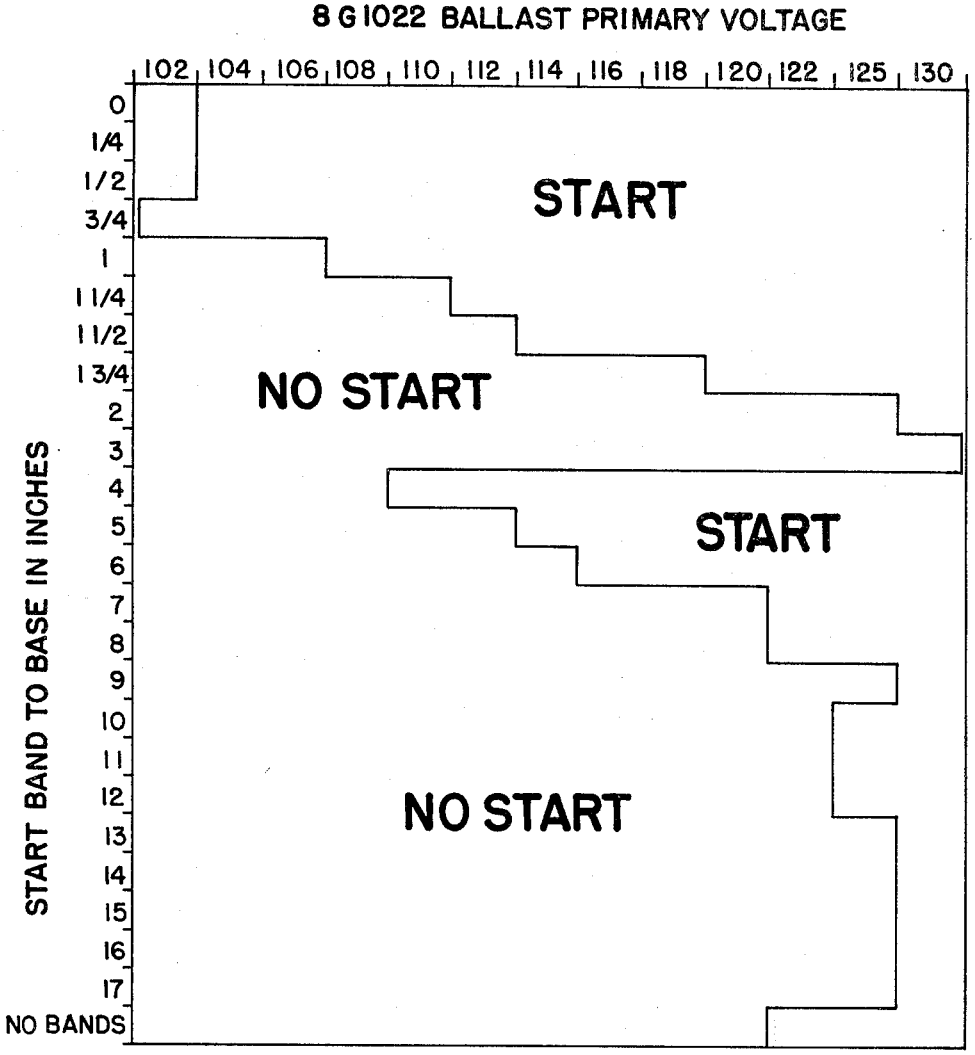
FIG. 7 is a plot of starting voltages of a U-shaped lamp with the starting aid of the invention at various positions along the bulb.

The desirability of providing the starting aid of the invention at the vicinity of the cathodes is illustrated in FIG. 7, which shows test results for a 35-watt Mod-U-Line lamp containing krypton, argon, and mercury, with a starting aid strap of the type shown in FIGS. 1 through 3 located at different distances from the ends of the lamp. In such a lamp, the cathodes are positioned ¾ inch from the open ends of the bulb. As shown in FIG. 7, with the starting aid positioned ¾ inch from the ends of the bulb, i.e., at the vicinity of the cathodes, the lamp typically started at about 100 primary volts, whereas with the starting aid at other locations along the bulb, the starting voltage was required to be higher, and as high as about 130 primary volts with the starting aid located about 2 or 3 inches from the ends of the bulb. Surprisingly, with the starting aid positioned 4 inches from the bulb ends, the starting voltage reduced to about 110 volts.

The invention is particularly useful on high efficiency discharage lamps containing krypton gas which causes the lamps to be more difficult to start.

While preferred embodiments and modifications of the invention have been shown and described, various other embodiments and modifications thereof will become apparent to persons skilled in the art and will fall within the scope of the invention as defined in the following claims.

What I claim as new and desire to secure by Letters Patent of the United States is:

1. A mercury vapor discharge lamp comprising an elongated bulb shaped so that its ends are substantially closer together than if the bulb were straight and containing electrodes respectively near said ends thereof, and a starting aid comprising conductive means respectively adjacent to said bulb in the vicinity extending from the base to about the position of said electrodes of said ends, and spatially extending means electrically interconnecting said conductive means, said starting aid being devoid of means for connection to a starting voltage source.

2. A discharge lamp comprising an elongated U-shaped bulb having a pair of parallel legs, so that its ends are substantially closer together than if the bulb were straight and containing electrodes respectively near said ends thereof, and a starting aid comprising conductive means respectively adjacent to said bulb in the vicinity of said electrodes, and spatially extending means electrically interconnecting said conductive means, in which said interconnecting means comprises a conductive member extending between said pair of parallel legs near said ends thereof.

3. A lamp as claimed in claim 2, in which said interconnecting means extends in a plane defined by said electrodes.

4. A lamp as claimed in claim 2, in which said lamp includes a support means extending across the ends of the bulb, said support means comprising said interconnecting means.

5. A discharge lamp comprising an elongated bulb that is U-shaped and has a pair of parallel legs so that its ends are substantially closer together than if the bulb were straight and containing electrodes respectively near said ends thereof, and a starting aid comprising conductive means respectively adjacent to said bulb in the vicinity of said electrodes, and support means extending across said ends of the bulb and electrically interconnecting said conductive means, said conductive means and interconnection thereof comprising a pair of dual C-shaped conductive members respectively at the ends of said bulb, said members comprising a pair of C-shaped members spaced apart in parallel relationship and interconnected by a conductive means, one of each of said C-shaped members being respectively around said bulb legs in the vicinity of said electrodes and the other of said C-shaped members being in electrical contact with said support means.

6. A discharge lamp in combination with a lighting fixture having a conductive sheet-like member, said lamp comprising an elongated bulb shaped so that its ends are substantially closer together than if the bulb were straight and containing electrodes respectively near said ends thereof, and a starting aid comprising conductive means respectively adjacent to said bulb in the vicinity of said electrodes, and spatially extending means electrically interconnecting said conductive means, said lamp being positioned near and parallel to said sheet-like member, and said conductive means comprising C-shaped members of which the openings of the C-shapes face toward said conductive sheet-like member.

7. A lamp as claimed in claim 1, in which said lamp is provided with a gas fill comprising krypton.

8. A lamp as claimed in claim 7, in which said gas fill further comprises argon and mercury.

* * * * *